US007516592B1

(12) United States Patent
Pratt

(10) Patent No.: US 7,516,592 B1
(45) Date of Patent: Apr. 14, 2009

(54) FOUNDATION CRACK SEALER AND METHOD OF USE

(76) Inventor: James M. Pratt, P.O. Box 920624, Needham, MA (US) 02492

( * ) Notice: Subject to any disclaimer, the term of this patent is extended or adjusted under 35 U.S.C. 154(b) by 615 days.

(21) Appl. No.: 11/094,633

(22) Filed: Mar. 31, 2005

(51) Int. Cl.
*E04B 1/66* (2006.01)

(52) U.S. Cl. ..... 52/741.4; 52/169.14; 52/302.3

(58) Field of Classification Search ..... 52/169.5, 52/169.14, 302.1, 302.3, 741.4, 408; 427/140, 427/207.1, 208; 428/63; 156/71, 90, 94
See application file for complete search history.

(56) References Cited

U.S. PATENT DOCUMENTS 5,160,328 A * 11/1992 Cartmell et al. ..... 604/307
5,814,031 A * 9/1998 Mooney et al. ..... 604/307
5,845,456 A * 12/1998 Read ..... 52/741.11
6,298,621 B1 * 10/2001 Lee ..... 52/302.6
6,405,508 B1 * 6/2002 Janesky ..... 52/741.4

* cited by examiner

*Primary Examiner*—Richard E Chilcot, Jr.
*Assistant Examiner*—Bryan Eppes
(74) *Attorney, Agent, or Firm*—William Nitkin

(57) ABSTRACT

A method and structure are disclosed for causing water seeping through a crack in a basement wall to be directed behind a tape applied to the wall, such tape having edges bonded to the wall and a hydrophobic coating on the rear side of the tape for repelling water flowing therebehind for quicker drainage.

3 Claims, 1 Drawing Sheet

FOUNDATION CRACK SEALER AND METHOD OF USE

BACKGROUND OF THE INVENTION

1. Field of the Invention

The field of this invention relates to structures and methods for dealing with water leaks into basements through cracks which have developed in foundation walls and more particularly relates to a structure and method of sealing the crack and preventing the flow of water into the basement area desired to be kept dry.

2. History of the Prior Art

Structures and methods to try to stem the flow of ground water through cracks in a foundation into a basement area are well known. Some of these inventions are directed toward structures which cover the cracks and direct the water flow to the basement floor or to drainage means therebelow. One such invention is found in U.S. Pat. No. 5,974,755 to Pouwels. This invention teaches the attachment of a wall patch over the crack where the water drains through the crack behind the patch to the floor where it can be drained away by conventional means. The wall patch of Pouwels is an elongated, stiff, flat panel which forms a generally longitudinally extending waterway having curbs on each side of the panel which curbs form a watertight seal against the wall such that any water flow through the crack passes behind the patch down to the floor area. Another approach to the problem is found in Janesky U.S. Pat. No. 6,405,508 which discloses a thin, flexible barrier material, the back of which is covered with a water wicking fabric and the sides of which are bonded to the basement wall on each side of the crack such that any fluid passing through the crack is absorbed by the strip of water-absorbing fabric and wicked through the fabric eventually down to a water drain system at the base of the wall.

SUMMARY OF THE INVENTION

It is an object of this invention to provide a more efficient crack-sealing structure and method than that found in the prior art. While Pouwels provides a rigid wall patch which must be sealed over the crack, it can be difficult to place on irregular surfaces. The flexible patch of Janesky has a backing of water-wicking fabric which retains moisture behind the entire patch. The Applicant herein has provided a tape that can be extended over a crack and adhered at the tape's edges, the tape being of waterproof material to direct the water flow from the crack down the foundation wall to a drainage means. On the rear of the tape is a coating of hydrophobic like material such as a gel-like petroleum product or the like to cause the water seepage to flow quickly down the inside of the tape to where it can be drained rather than to be retained by wicking structure as done in the prior art. This faster drainage allows for greater seepage to be directed to below floor level drainage means without holding and retaining the water in position behind the tape, thereby allowing more water to be directed out of the basement area by the tape of this invention than is currently directed by the prior art. The tape of this invention is flexible and can be made of rubber-like material with edges that have small perforations therethrough so that when adhesive is applied to the tape edges, it can better retain the tape to the foundation wall and the hydrophobic coating on the rear of the tape, such as a Vaseline petroleum product, will promote the quick flow of water behind the tape between the sealed edges from the foundation crack to the floor where an entry to a subfloor draining system can be provided.

DESCRIPTION OF THE PREFERRED EMBODIMENT(S)

Figure 1:
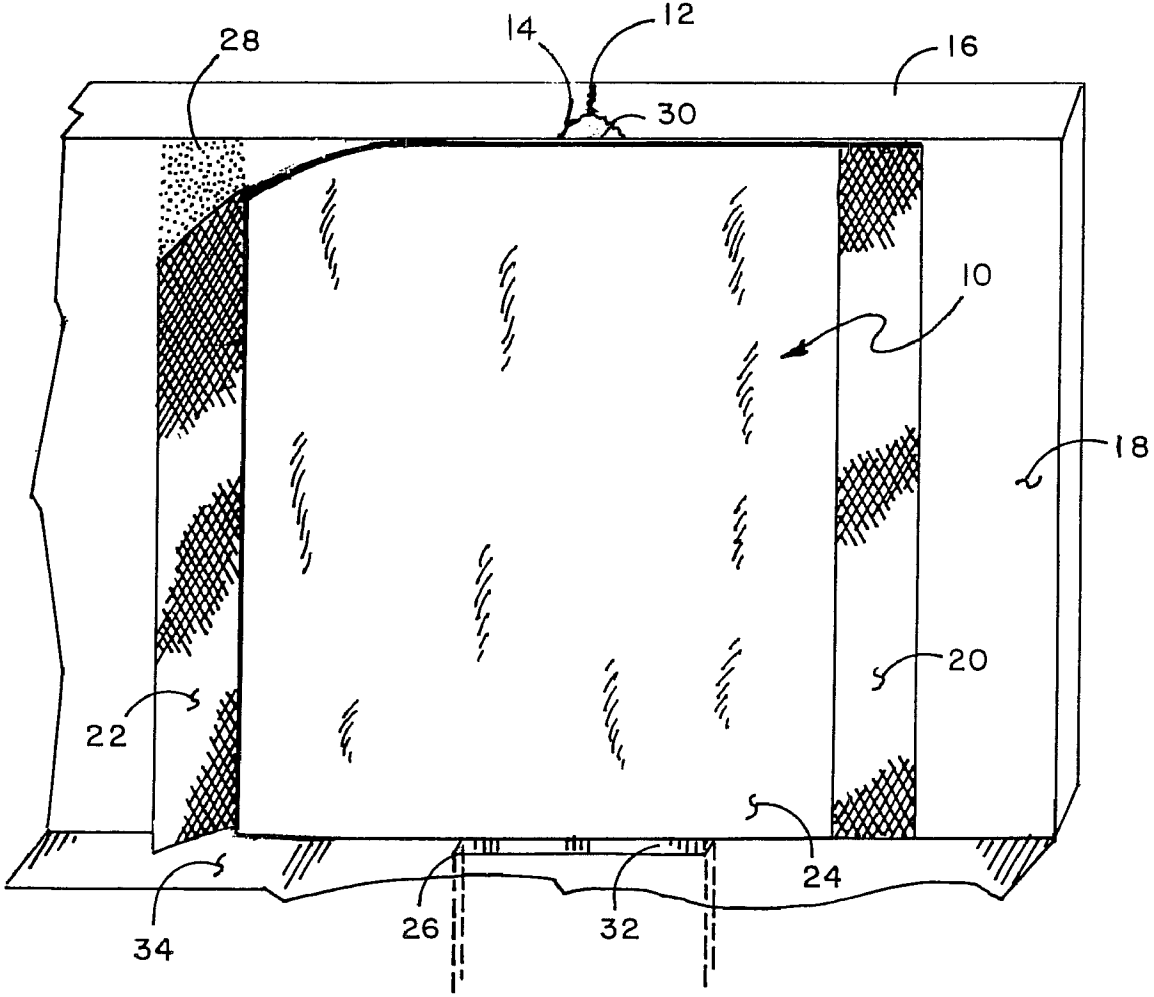
FIG. 1 illustrates a front perspective view of the tape of this invention applied to a wall.

FIG. 1 illustrates a perspective view of a section of a basement wall 18 which can be a typical wall made of concrete, masonry or the like. In this wall is crack 12, allowing ground water 26 to pass through foundation wall 16 into the basement area. The method of sealing crack 12 first involves sealing it with a polyurethane sealant 30 and then covering it with tape 10 of this invention that is longitudinally disposed on the wall to direct the water flow therebehind from the crack to floor area 34 where the water can pass through an entry 32 to a subfloor drain or drywell, not shown, which systems are well known in the art. Longitudinally disposed on each side edge of tape 10 are first side edge webbing 20 and second side edge webbing 22. Side edge webbing can be provided with a plurality of small perforations therein to receive adhesive 28 therethrough to better bond first and second side edge webbing's 20 and 22 to wall 18. The central portion 24 of tape 10 can be made of a flexible, rubber-like material that is waterproof and provides a flexible water barrier. Central portion 24 of tape 10 can be made of an elastomeric rubber or equivalent material. The rear of the central portion of tape 10 is coated with a hydrophobic material such as VASELINE brand petroleum jelly or equivalent so as not to absorb water but instead to allow the water 26 coming through crack 12 to be repelled by tape 10 and to pass quickly behind tape 10, being pulled downward by gravity behind the central portion of tape 10 to floor area 34 into entry 32 to a subfloor drainage means. Water cannot escape along the sides of tape 10 beyond the central portion's rubber-like tape area as first and second edge webbing's 20 and 22 are bonded to wall 18 with a waterproof adhesive. Tape 10 can be made in many widths, usually between 3-8 inches, and can be applied over cracks to direct the water seeping therethrough to the floor area or drain system without such water coming into the basement or making the room damp.

Although the present invention has been described with reference to particular embodiments, it will be apparent to those skilled in the art that variations and modifications can be substituted therefor without departing from the principles and spirit of the invention.

I claim:

1. A method for causing water seeping through a crack having a length in a basement wall to be directed to the subfloor for drainage, comprising the steps of:

providing a waterproof tape having an inner central portion, first and second sides on each side thereof, and a rear side;

coating the rear side of said inner central portion of said tape with a hydrophobic gelled petroleum product material;

after coating the rear side of said inner central portion of said tape with a hydrophobic gelled petroleum product material, applying said tape over the length of said crack;

bonding the rear side of said first and second sides of said tape to said wall in a waterproof fashion;

repelling water from said coated rear side of said tape's central portion; and speeding the flow of said water down said wall by said repelling for quicker drainage.

2. The method of claim 1 further including the step of filling said crack with a sealant before applying said tape.

3. A method for causing water seeping through a crack having a length in a basement wall to be directed to a subfloor for drainage, comprising the steps of:

providing a waterproof strip of material having an elongate central portion and first and second elongate side portions;

applying a first material, comprising a hydrophobic semi-solid gelled petroleum product to the elongate central portion of the waterproof strip;

applying a second material, comprising a waterproof adhesive, to the first and second elongate side portions; and applying the strip over the length of the crack with the central portion overlying the crack and the first and second elongate side portions being spaced from the crack so that the waterproof adhesive bonds to the wall.

* * * * *